United States Patent [19]

Cohen

[11] 4,418,883

[45] Dec. 6, 1983

[54] SELF-SUPPORTING, TABLE-MOUNTED, SUPPORT APPARATUS FOR RECEPTACLES

[76] Inventor: Daniel Cohen, 2515 Cummings Ave., Superior, Wis. 54880

[21] Appl. No.: 311,419

[22] Filed: Oct. 14, 1981

[51] Int. Cl.[3] ..... A47K 1/08

[52] U.S. Cl. ..... 248/312.1; 248/205 R

[58] Field of Search ..... 248/205 R, 226.1, 311.2, 248/312.1, 315; 108/25, 26, 26.2, 93, 152, 161; 297/174, 134

[56] References Cited

U.S. PATENT DOCUMENTS

| | | | |
|---|---|---|---|
| 1,620,407 | 3/1927 | Streif | 211/74 |
| 1,993,702 | 3/1935 | Brunhoff | 211/74 |
| 2,331,511 | 10/1943 | Schiffman | 248/205.1 X |
| 2,601,571 | 6/1952 | Sverkerson | 248/311.2 X |
| 2,771,332 | 11/1956 | McGinley | 108/152 X |
| 2,926,794 | 3/1960 | Karoff | 108/26 X |
| 3,243,048 | 3/1966 | Lang | 211/74 |
| 4,248,478 | 2/1981 | Aron | 297/174 |

FOREIGN PATENT DOCUMENTS

| | | | |
|---|---|---|---|
| 208446 | 12/1923 | United Kingdom | 248/311.2 |

*Primary Examiner*—J. Franklin Foss

*Attorney, Agent, or Firm*—Schwartz & Weinrieb

[57] ABSTRACT

A self-supporting, table-mounted support apparatus for receptacles, particularly for ice buckets for housing wine bottles, includes an upper set of laterally spaced support arms and a lower support arm which cooperate so as to define a horizontal channel therebetween within which a projecting portion of a dining table can be disposed and from which the apparatus will be suspended. The upper arms comprise the ends of a C or U-shaped member disposed within a horizontal plane, while the lower arm comprises one end of a J-shaped member disposed within a vertical plane, the other end of the lower arm being connected to the upper arm member at a central location within the plane of the upper member, the overall framework therefore being substantially T-shaped in configuration. A cross-bar may connect the upper arms so as to define therewith an annular ring member within which the receptacle is housed internally of the framework, or a separate annular ring member may be fixedly or pivotably secured to the upper arm member whereby the receptacle is supported in a mode external of the three support arms engaging the table.

20 Claims, 3 Drawing Figures

SELF-SUPPORTING, TABLE-MOUNTED, SUPPORT APPARATUS FOR RECEPTACLES

FIELD OF THE INVENTION

The present invention relates generally to support apparatus, and more particularly to support apparatus for supporting, for example, an ice bucket for wine bottles or the like, wherein the apparatus is self-supporting from a horizontally disposed table surface.

BACKGROUND OF THE INVENTION

Very often when people dine in restaurants, particularly during the evening hours, the diners will order wine as a desirable accompaniment to the edibles comprising their meal. Conventionally, the wine is provided to the diners by disposing the wine bottle within an upright support of the standard type which is self-standing and normally placed at a location adjacent the table at which the diners are seated. The wine is rarely served by merely placing the bottle upon the dining table for in some restaurant establishments, such a practice is simply not considered to be proper dining etiquette. In addition, the available surface area of the dining table is normally limited and does not readily permit the utilization of such for the support of non-essential accessories. As may well be appreciated, the available table surface area is normally utilized for supporting the requisite dinnerware comprising several meal courses simultaneously, flatware utensils, stemware, food seasonings, and the like.

The primary difficulty or disadvantage often encountered as a result of the employment of such standard type wine bottle-holding ice bucket support apparatus resides in the fact that such apparatus exhibits a relatively low level of stability. Not only can such apparatus be accidentally knocked over by means of, for example, one of the diners seated adjacent to the standard support when he or she may be reaching for the wine bottle while, for example, being pre-occupied with dinner conversation, but as has also been experienced, such support apparatus is readily capable of being inadvertently knocked over upon one of the diners, seated adjacent to the standard support, arising from his or her dinner chair in order to leave the dining table for any one of a variety of reasons. Anyone having experienced such an accidental occurrence can readily appreciate how frustrating, humiliating, and embarrassing such an event can be.

Consequently, if there existed support apparatus for receptacles in general, and for wine bottle-ice buckets in particular, which could be securely mounted directly upon an edge portion of the dining table, the aforenoted disadvantageous characteristics of conventional standard type ice bucket support apparatus could be overcome while simultaneously preserving the necessary available table surface area for the dining requisites. A need therefore exists for such table-mounted support apparatus which could provide the service convenience of a standard type receptacle support apparatus while exhibiting a substantially degree of stability and propensity against inadvertent dislodgement from its support position.

OBJECTS OF THE INVENTION

Accordingly, it is an object of the present invention to provide a new and improved support apparatus.

Another object of the present invention is to provide a new and improved support apparatus for receptacles.

Still another object of the present invention is to provide a new and improved support apparatus for ice bucket receptacles which may, in turn, be utilized for supporting or housing a wine bottle during dining periods.

Yet another object of the present invention is to provide a new and improved support apparatus for ice bucket receptacles which is self-supporting from a horizontally disposed edge portion of the dining table.

Still yet another object of the present invention is to provide a new and improved support apparatus for ice bucket receptacles which is self-supporting from a horizontally disposed edge portion of the dining table and thereby overcomes the various disadvantages, particularly that of instability, characteristic of conventional standard type support apparatus.

Yet still another object of the present invention is to provide a new and improved support apparatus for receptacles which is securely mountable directly upon a horizontally disposed edge portion of the dining table and is not readily dislodged therefrom.

A further object of the present invention is to provide a new and improved support apparatus for ice bucket receptacles which is capable of providing the requisite convenience of readily available service of wine, for example, from a wine bottle disposed within the receptacle while preserving the limited table surface area for the dining requisites.

A still further object of the present invention is to provide a new and improved support apparatus for ice bucket receptacles which is capable of disposing the receptacle at a location which is adjacent to, but off of, the dining table surface area so as to in fact provide service convenience of wine, for example, from a wine bottle disposed within the receptacle while simultaneously preserving the limited table surface area for the dining requisites.

A yet further object of the present invention is to provide a new and improved support apparatus for receptacles which is considerably simplified in its structural system.

A still further object of the present invention is to provide a new and improved support apparatus for receptacles which exhibits a considerably simplified structural system yet adequately supports the receptacles of the aforenoted type, even when filled with ice and having a wine bottle disposed therein.

A yet still further object of the present invention is to provide a new and improved support apparatus for receptacles which exhibits a considerably simplified structural system yet is sufficiently rigidified so as to adequately support the receptacles in a cantilevered manner relative to the table edge surface portion.

An additional object of the present invention is to provide a new and improved support apparatus for receptacles which exhibits a considerably simplified structural system with sufficient rigidity for adequately supporting the receptacles, and which additionally exhibits a requisite amount of flexibility so as to permit the apparatus to be securely mounted directly upon the table edge portion.

A still additional object of the present invention is to provide a new and improved support apparatus for receptacles which is readily capable of being easily mounted upon, and dismounted from, a horizontally disposed table surface edge portion so as to provide the service convenience desired.

A yet additional object of the present invention is to provide and new and improved support apparatus for receptacles wherein the structural framework of the apparatus is fabricated of strong and durable material so as to adequately support the receptacle even under load conditions.

A still yet additional object of the present invention is to provide a new and improved support apparatus for receptacles which may be economically manufactured by mass-production techniques.

A yet still additional object of the present invention is to provide a new and improved support apparatus for receptacles which may be utilized in conjunction with a variety of different types or kinds of tables regardless of the type of support structure supporting the table per se.

SUMMARY OF THE INVENTION

The foregoing and other objectives are accomplished in accordance with the present invention through the provision of a self-supporting, table-mounted, support apparatus for receptacles, and in particular for ice buckets which are adapted for housing a supply of ice and a wine bottle therewithin, which comprises substantially annular or ring means which is adapted to support the receptacle as a result of the disposition of the annular or ring means beneath an annular flange or lip defined within the uppermost portion of the receptacle. The annular or ring means is operatively associated with a support arm framework which permits the apparatus to be readily mounted upon, and dismounted from, a horizontally disposed edge portion of a table surface. The support arm framework comprises a pair of laterally spaced upper arms which are disposed substantially within the plane of the receptacle flange or lip, and a lower arm which is substantially J-shaped with the upper end of this lower arm being integrally connected to the central portion of the upper arm structure which is substantially C or U-shaped in configuration. The overall support arm structure therefore has a substantially T-shaped configuration.

The free ends of the upper arm structure project downwardly so as to engage the upper surface of the table upon which the apparatus of the present invention is to be mounted, while the free end of the lower arm projects upwardly so as to engage the undersurface of the table, the free ends of the three arms thereby defining a channel therebetween within which the edge portion of the table is to be disposed when in fact the apparatus is mounted upon the table. In accordance with a first embodiment of the apparatus of the present invention, a cross-bar is integrally interposed and connected between the pair of laterally spaced upper arms so as to form therewith the annular or ring means supporting the receptacle.

In accordance with a second embodiment of the present invention, the annular or ring means is fixedly secured to the central portion of a cross-bar interconnecting the two laterally spaced upper arms. In this embodiment, the ice bucket receptacle is supported by the apparatus of the present invention solely by means of this annular or ring means being disposed beneath an annular flange or rim of the bucket, whereas in accordance with the first embodiment of the present invention, the receptacle may also rest upon the horizontally disposed leg portion of the lower arm whereby the annular or ring means may merely serve to retain the body of the receptacle within the support apparatus of the present invention.

In accordance with a third embodiment of the present invention, the annular or ring means for freely supporting the receptacle in a manner similar to that of the second embodiment is pivotably secured to the central portion of the cross-bar interconnecting the two laterally spaced upper arms. In this manner, the receptacle can pivot within a horizontal plane about a vertical axis such that accessibility to the receptacle, and to the contents thereof, for example, a wine bottle, is facilitated from either side of the location at which the receptacle is mounted upon the table edge portion.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts through the several views, and wherein.

DETAILED DESCRIPTION OF THE ILLUSTRATED EMBODIMENTS

Figure 1:
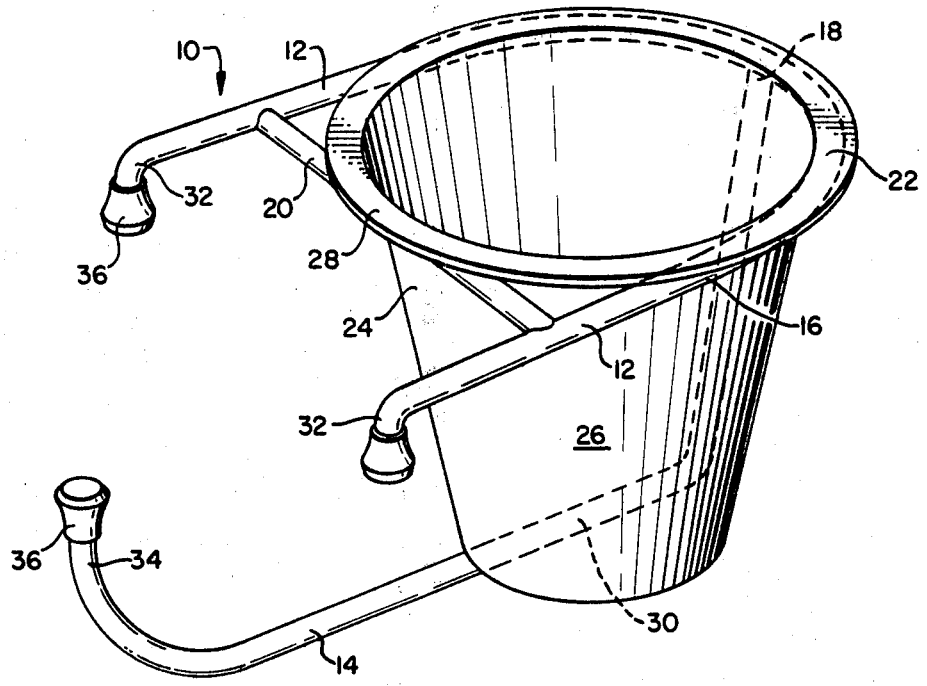
FIG. 1 is a perspective view showing a first embodiment of a self-supporting, table-mounted, support apparatus for receptacles, and in particular, for ice buckets for housing wine bottles, constructed in accordance with the present invention and showing its operative mode.

Referring now to the drawings, and more particularly to FIG. 1 thereof, a first embodiment of a self-supporting, table-mounted support apparatus for receptacles, particularly for ice bucket receptacles for holding or housing wine bottles, constructed in accordance with the present invention is disclosed and generally indicated by the reference character 10. As can readily be seen, the support apparatus of the present invention comprises an integral, one-piece support arm framework which comprises an upper pair of laterally spaced arms 12 and a lower arm 14. The upper arms 12 are defined by the two legs of a substantially C or U-shaped element 16 which is disposed within a horizontal plane, while the lower support arm element 14 is substantially J-shaped in configuration and is disposed within a substantially vertical plane. The uppermost end of support arm element 14 is integrally fixedly connected to the central portion of upper support arm element 16 at a location defined substantially within the plane of element 16 as indicated at 18, such as, for example, by conventional welding techniques or the like. As a result of this structural arrangement and interconnection system, the support framework of the support apparatus of the present invention has a substantially T-shaped configuration.

As will be apparent from the discussion set forth hereinbefore, the present invention is of course particularly concerned with the support of receptacles, and in particular, ice bucket receptacles which can in turn hold or house a bottle of wine. In order to further provide for such support mode, the projecting or free ends of the upper, laterally spaced support arms 12 are interconnected by means of a cross-bar 20. In this manner, the cross-bar 20, together with the support arms 12 and the arcuate portion 22 of element 16, defines an annular or ring means which can engage the body portion 24 of a suitable receptacle 26 so as to retain the receptacle 26 within the support apparatus 10 in a confined mode. It is to be appreciated that the lineal distance defined between cross-bar 20 and the interconnection point 18 defined between the arm elements 14 and 16, is substantially the same as the lateral spacing distance defined between the upper arms 12 such that the annular or ring means defined by cross-bar 20, arms 12, and arcuate portion 22, can in fact accommodate a receptacle 26 having a predetermined diameter. Of course, the particular dimensions of the entire support apparatus, including the lateral spacing between arms 12, as well as the lineal distance defined between cross-bar 20 and interconnection point 18, can be altered so as to accommodate different sized receptacles having different diametrical dimensions.

The receptacle or ice bucket 26 is also preferably provided with an annular flange or rim 28 at the uppermost point or upper end thereof, and it is desired that the flange or rim 28 rest or be disposed upon the annular or ring means defined by the cross-bar 20, the laterally spaced arms 12, and the arcuate portion 22 of element 16. In this manner, the receptacle, particularly under load conditions, is adequately supported within the support apparatus of the present invention.

As will be noted with respect to the apparatus embodiment of FIG. 1, the ice bucket receptacle is supported by means of the apparatus 10 at a position internally within the apparatus. In accordance with a further feature of this particular embodiment of the present invention, in order to assure confinement of the receptacle internally within the apparatus, the bottom of the receptacle may be permitted, or may intentionally be disposed, to rest or be supported upon the forwardly extending, horizontally disposed, leg portion 30 of lower arm element 14. In this mode, the annular or ring means defined within the upper plane comprising arms 12, cross-bar 20, and arcuate section 22, may simply engage the upper portion of body 24 of receptacle 24 or actually engage the underside of flange or rim 28 of receptacle 26 while the receptacle rests upon lower arm leg portion 30.

When the support apparatus of the present invention is to be used in its operative mode, it is adapted to be self-supporting from a horizontally disposed edge portion of, for example, a dining table. In order to facilitate such an operative mode, and to enable the apparatus of the present invention to be mounted upon the dining table, it is noted that the forwardmost ends 32 of the upper arms 12 depend downwardly while the forwardmost end 34 of the lower arm 14 extends upwardly. In this manner, the ends of the upper and lower arms can operatively engage the upper and lower or under surfaces of the table edge portion, respectively, not shown. In particular, the dependent ends 32 of the upper arms 12 will be disposed within a horizontal plane, while the upstanding end 34 of lower arm 14 will be disposed within another horizontal plane disposed somewhat beneath the plane of ends 32. A channel is therefore defined between the planes of the upper and lower arms within which the table edge portion is to be disposed when the support apparatus of the present invention is mounted upon the table. The vertical spacing defined between the planes of the upper and lower arms, and therefore thereby defining the height of depth of the aforenoted channel, is preferably less than the thickness of the table edge portion such that when the apparatus of the present invention is mounted upon the table edge portion as a result of the lower arm end 34 engaging the lower or undersurface of the table edge portion while the upper arm ends 32 engage the upper surface of the table edge portion, the support arms will tightly and frictionally engage the respective surfaces of the table thereby securely mounting the apparatus upon the table and preventing inadvertent dislodgement therefrom.

In order to prevent marring of the table surfaces, as well as to increase the frictional engagement of the arms ends 32 and 34 with respect to the table surfaces, the terminal ends 32 and 34 of the arms 12 and 14 may be provided with rubber cushion tips or caps 36. it is lastly noted that with respect to the support apparatus of the present invention, that with respect to the lower support arm structure 14, the forwardly extending leg portion 30 and the arcuately, upwardly extending terminal end portion 34 permit the apparatus of the present invention to be utilized in conjunction with a dining table having a dependent or vertically disposed skirt, not shown.

The support arm members comprising the framework of the support apparatus of the present invention are fabricated of metal rod or tubing, and the particular metal chosen may be, for example, steel, aluminum, chrome-plated steel, or the like. It is desirable to render the support arms as light in weight as is possible, yet of sufficient strength capable of adequately withstanding the various bending moments and stresses to which the apparatus will be subjected, particularly under load conditions. It has been found, for example, that while steel is heavier than aluminum, the strength properties of steel are greater than those of aluminum. Consequently, in fabricating the tubular members employed in making the support arms 12 and 14 of the apparatus, the wall thickness of the tubing may be less in the case of steel tubing than that of aluminum tubing as the latter must have greater wall thickness dimensions in order to exhibit similar strength properties of steel tubing. Such considerations can be accounted for in selecting the tubing to be utilized. Another consideration to be accounted for is which tubing, with its corresponding wall thickness, will also impart the requisite flexibility to the support arm structures of the apparatus in order to in fact permit the apparatus to be easily mounted upon, or dismounted from, the table surface.

Figure 2:
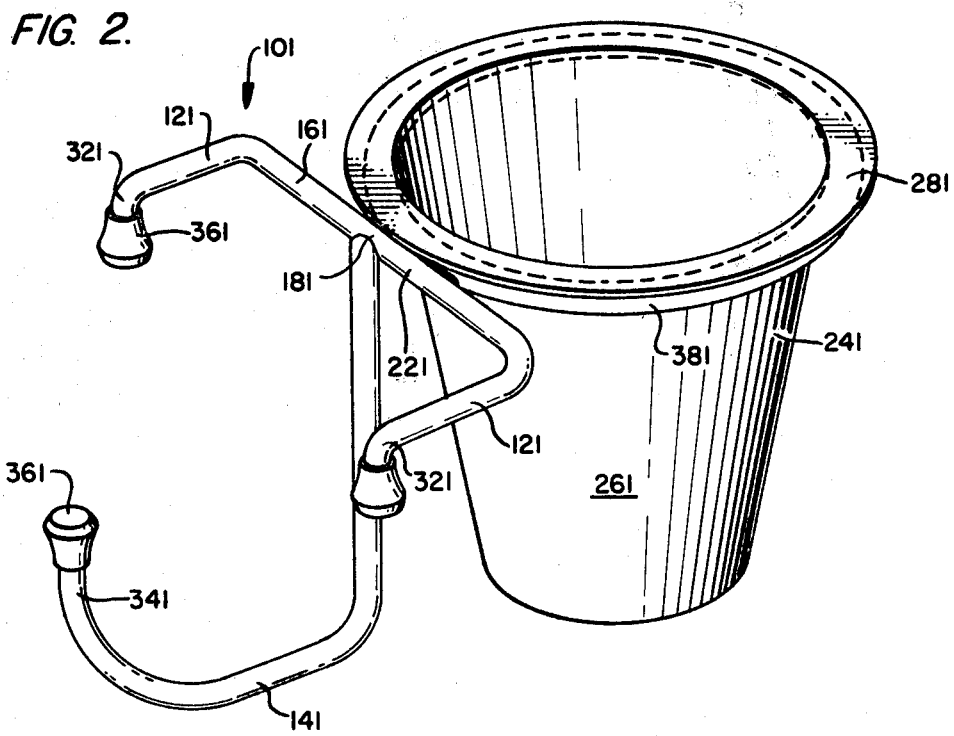
FIG. 2 is a view similar to that of FIG. 1, showing however, a second embodiment of a self-supporting, table-mounted, support apparatus for receptacles, particularly for ice buckets for housing wine bottles, constructed in accordance with the present invention and showing its operative mode.

Referring now to FIG. 2, a second embodiment of the present invention is disclosed as generally indicated by the reference character 101. Like or corresponding structural components of this embodiment are seen to be similarly numbered by reference characters similar to those of the embodiment of FIG. 1 with the addition of a "1" afterwards. Appreciation of the embodiment of FIG. 2, as compared to that of FIG. 1, immediately conveys conveys the fact that within the embodiment of FIG. 2, the receptacle ice bucket is supported by means of an annular ring member 381 which is provided as a separate structural element relative to the support arm structural system comprising upper support arms 121 and lower support arm 141. In addition, the ring member 381 projects outwardly away from the support apparatus in a direction opposite to that in which the lower support arm 141 extends relative to the rear cross-bar 221 of the upper arm element 161. In this manner, therefore, it will be further appreciated that the ice bucket receptacle is disposed and supported, solely by means of its flange or rim 281 resting upon or being supported by annular ring member 381, entirely externally of the support apparatus as opposed to being confined internally within the support apparatus as is characteristic of the embodiment of FIG. 1. The ring member 381 is of course welded to the upper support arm element 161 at the same location 181 at which the lower support arm element 141 is welded to element 161.

Figure 3:
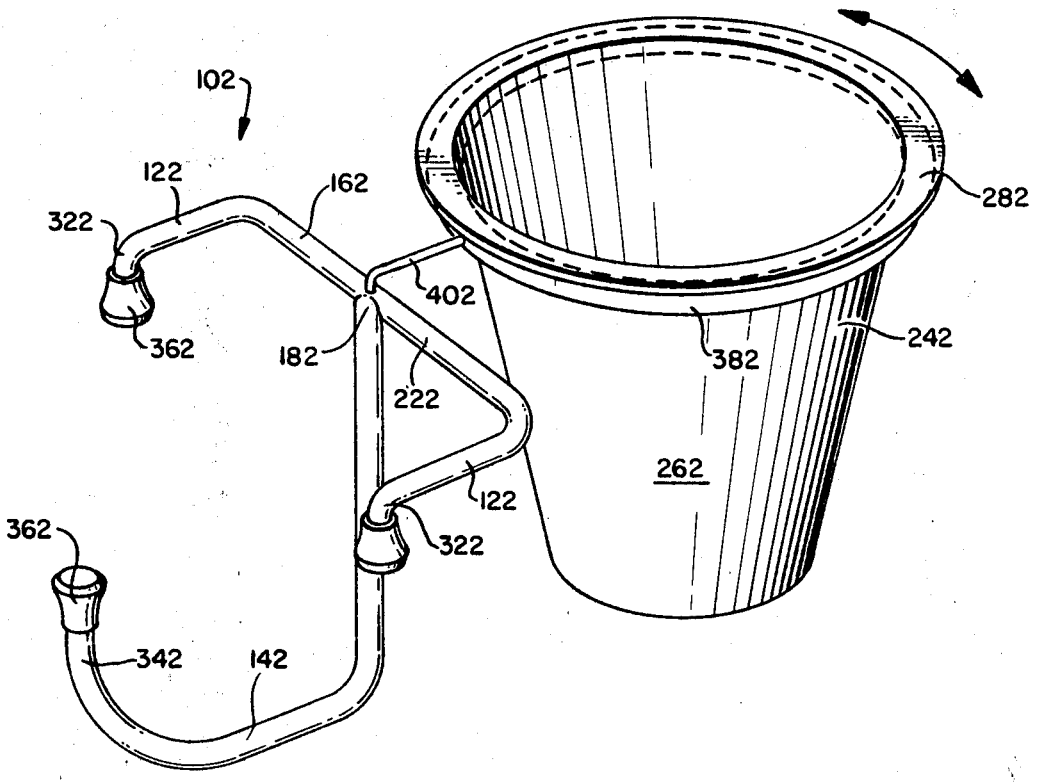
FIG. 3 is a view similar to that of FIG. 1, showing however, a third embodiment of a self-supporting, table-mounted, support apparatus for receptacles, particularly for ice buckets for housing wine bottles, constructed in accordance with the present invention and showing its operative mode.

Lastly considering the third embodiment of the present invention as disclosed in FIG. 3, it is seen that this embodiment is similar to that of the embodiment of FIG. 2 with the additional feature that the embodiment of FIG. 3, generally indicated by the reference character 102, and wherein each component is similarly numbered with the last digit being "2", permits the ice bucket receptacle support ring member 382 to be pivotably movable relative to the support arm member framework comprised of elements 162 and 142. This mode of operation is facilitated by the elimination of the weld defined between ring member 382 and upper arm element 162 at location 182, and the substitution therefor of a mounting bracket 402 which is fixedly secured to ring member 382 yet pivotably secured within upper arm element 162 at the weld location 182. The bracket 402 is substantially L-shaped such that the dependent leg thereof is pivotably disposed within arm element 162 whereby the support ring 382, and its supported receptacle 262, may be pivotably moved within a horizontal plane about the vertical axis defined by the vertical leg of bracket 402. In this manner, the receptacle bucket may be advantageously disposed or moved by one of the diners in order to provide ready access to the contents of the bucket receptacle.

Obviously, many modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. Apparatus for supporting receptacles relative to a horizontally disposed table surface, comprising:

first support arm means, comprising a pair of laterally spaced arms and a cross-bar interconnecting said laterally spaced arms, disposed within a horizontal plane;

substantially J-shaped second support arm means, disposed within a vertical plane, integrally connected to said first support arm means at a location defined within said horizontal plane so as to form therewith a one-piece support arm framework;

said first and second support arm means defining a horizontal channel therebetween within which said table surface is to be disposed and wherein said first and second support arm means engage the upper and under surfaces of said table, respectively; and annular ring means operatively connected to said one-piece support arm framework for supporting a receptacle relative to said table surface.

2. Apparatus as set forth in claim 1, wherein:

said first support arm means comprises a substantially C shaped member.

3. Apparatus as set forth in claim 1, wherein:

said one-piece framework comprises a substantially T-shaped configuration.

4. Apparatus as set forth in claim 1, wherein:

said annular ring means is defined internally within said one-piece framework.

5. Apparatus as set forth in claim 4, wherein:

said receptacle rests upon said second support arm means when disposed within said annular ring means.

6. Apparatus as set forth in claim 1, wherein:

said annular ring means is defined by said laterally spaced arms and said cross-bar.

7. Apparatus as set forth in claim 1, wherein:

said receptacle is provided with an annular flange at the upper end thereof; and said annular ring means is disposed beneath said annular flange for supporting said receptacle.

8. Apparatus as set forth in claim 1, further comprising:

means secured to one of said first and second support arm means for preventing marring of said table surfaces.

9. Apparatus as set forth in claim 8, wherein:

said marring preventing means comprises rubber caps.

10. Apparatus as set forth in claim 1, wherein:

said first and second support arm means comprise tubular members.

11. Apparatus as set forth in claim 10, wherein:

said tubular members are fabricated of chrome-plated steel.

12. Apparatus as set forth in claim 1, wherein:

said annular ring means is disposed externally of said one-piece framework.

13. Apparatus as set forth in claim 12, wherein:

said annular ring means is fixedly secured to said one-piece framework so as to extend in a direction away from said table surface.

14. Apparatus as set forth in claim 12, wherein:

said annular ring means is pivotably secured to said one-piece framework so as to extend in a direction away from said table surface.

15. Apparatus as set forth in claim 14, further comprising:

bracket means interconnecting said annular ring means to said one-piece framework for permitting said annular ring means and said supported receptacle to pivot within a horizontal plane about a vertical axis.

16. Apparatus as set forth in claim 1, wherein:

said annular ring means is disposed within said horizontal plane.

17. Apparatus as set forth in claim 1, wherein:

said annular ring means suspendingly supports said receptacle in an off-the-table mode.

18. Apparatus for supporting receptacles relative to a horizontally disposed table surface, comprising:

first support arm means, comprising a pair of laterally spaced arms and a cross-bar interconnecting said laterally spaced arms, disposed within a horizontal plane;

second support arm means integrally connected to said first support arm means at a location defined within said horizontal plane so as to form therewith a one-piece support arm framework;

said first and second support arm means defining a horizontal channel therebetween within which said table surface is to be disposed and wherein said first and second arm support arm means engage the upper and under surfaces of said table, respectively;

receptacle means provided with an annular flange at the upper end thereof; and annular ring means operatively connected to said one-piece support arm framework for disposition beneath said annular flange of said receptacle means for supporting said receptacle relative to said table surface.

19. Apparatus as set forth in claim 18, wherein:

said second support arm means comprises a substantially J-shaped member.

20. Apparatus as set forth in claim 19, wherein:

said J-shaped member is disposed within a vertical plane.

* * * * *